US007143613B2

(12) United States Patent
Takimoto

(10) Patent No.: US 7,143,613 B2
(45) Date of Patent: Dec. 5, 2006

(54) KNITWEAR GARMENT AND METHOD OF KNITTING KNITWEAR

(75) Inventor: Masaki Takimoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/545,030

(22) PCT Filed: Jan. 30, 2004

(86) PCT No.: PCT/JP2004/000968

§ 371 (c)(1),
(2), (4) Date: Aug. 10, 2005

(87) PCT Pub. No.: WO2004/072344

PCT Pub. Date: Aug. 26, 2004

(65) Prior Publication Data

US 2006/0107700 A1 May 25, 2006

(30) Foreign Application Priority Data

Feb. 14, 2003 (JP) ..... 2003-037493

(51) Int. Cl.
*D04B 7/10* (2006.01)

(52) U.S. Cl. ..... 66/64; 66/176

(58) Field of Classification Search ..... 66/64, 66/176, 69, 70, 76, 169 R, 170, 171, 172 R
See application file for complete search history.

(56) References Cited

U.S. PATENT DOCUMENTS 3,474,643 A 10/1969 Robinson et al.

(Continued)

FOREIGN PATENT DOCUMENTS

EP 1 260 623 A1 11/2002

(Continued)

*Primary Examiner*—Danny Worrell
(74) *Attorney, Agent, or Firm*—Rothwell, Figg, Ernst & Manbeck, P.C.

(57) ABSTRACT

Seamless knitwear of mixed set-in and raglan sleeves, and a method of knitting the same seamless knitwear.

The knitwear of the present invention comprises a body and sleeves. A front body of the body has armhole parts and shoulder-line parts extending along one's shoulder line formed when wearing the knitwear, and a back body of the body has slant-line parts extending obliquely from neckline to side parts of the body. The front and back bodies are knitted in tubular form in a seamless manner, and the sleeves are knitted in tubular form in a seamless manner. The sleeves are joined to the armhole parts, the shoulder-line parts, and the slant-line parts of the front and back bodies in a seamless manner, and a neckline is formed by a part of the sleeves. The number of courses of the front and back bodies knitted in the course of joining of the sleeves to the armhole parts of the bodies is set so that the number of course of the back body knitted is decreased below the number of courses of the front body knitted. The number of courses of the front and back bodies knitted in the course of joining of the sleeves to the shoulder-line parts of the bodies is set so that the number of course of the back body knitted is increased over the number of courses of the front body knitted.

4 Claims, 5 Drawing Sheets

U.S. PATENT DOCUMENTS

| | | | | |
|---|---|---|---|---|
| 5,916,272 | A | 6/1999 | Nonnenmacher et al. | |
| 5,987,930 | A | 11/1999 | Nakai | |
| 6,286,340 | B1 * | 9/2001 | Yui | 66/70 |
| 6,658,899 | B1 * | 12/2003 | Okamoto | 66/64 |
| 6,668,593 | B1 | 12/2003 | Okamoto | |
| 6,672,113 | B1 * | 1/2004 | Okamoto | 66/76 |
| 2003/0000261 | A1 * | 1/2003 | Okamoto | 66/64 |
| 2003/0010068 | A1 | 1/2003 | Yui | |
| 2003/0106344 | A1 * | 6/2003 | Okamoto | 66/64 |
| 2004/0083766 | A1 * | 5/2004 | Okamoto et al. | 66/64 |
| 2005/0028562 | A1 * | 2/2005 | Urano et al. | 66/170 |
| 2005/0183465 | A1 * | 8/2005 | Yui | 66/64 |

FOREIGN PATENT DOCUMENTS

| | | | |
|---|---|---|---|
| GB | 2 228 750 | A | 9/1990 |
| JP | 31-10928 | | 7/1931 |
| WO | WO 01/57299 | A1 | 1/2001 |
| WO | WO 01/63030 | A1 | 8/2001 |
| WO | WO 01/64987 | A1 | 9/2001 |

* cited by examiner

Fig. 1 (A)
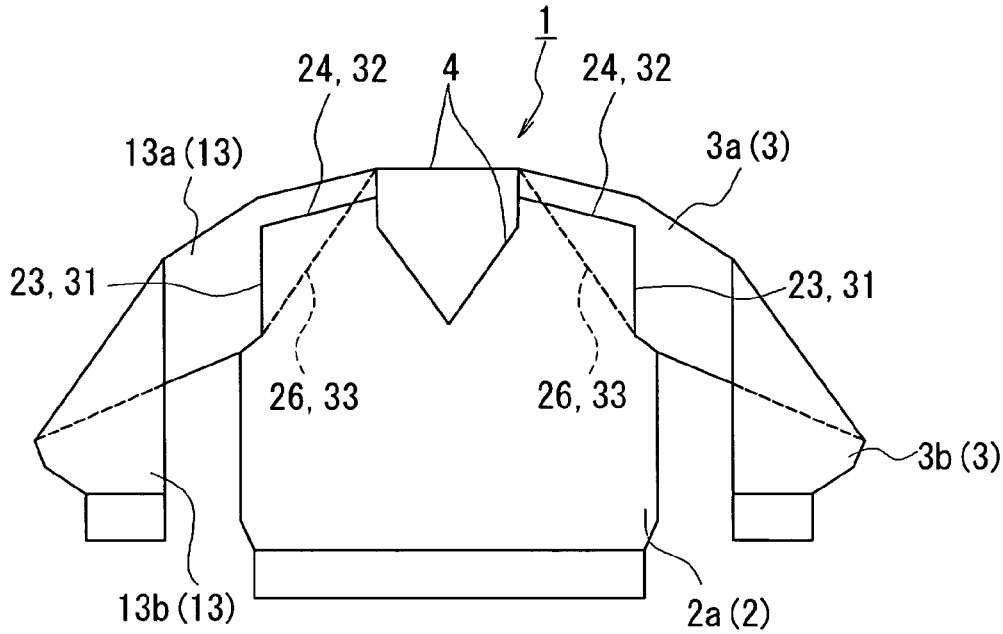
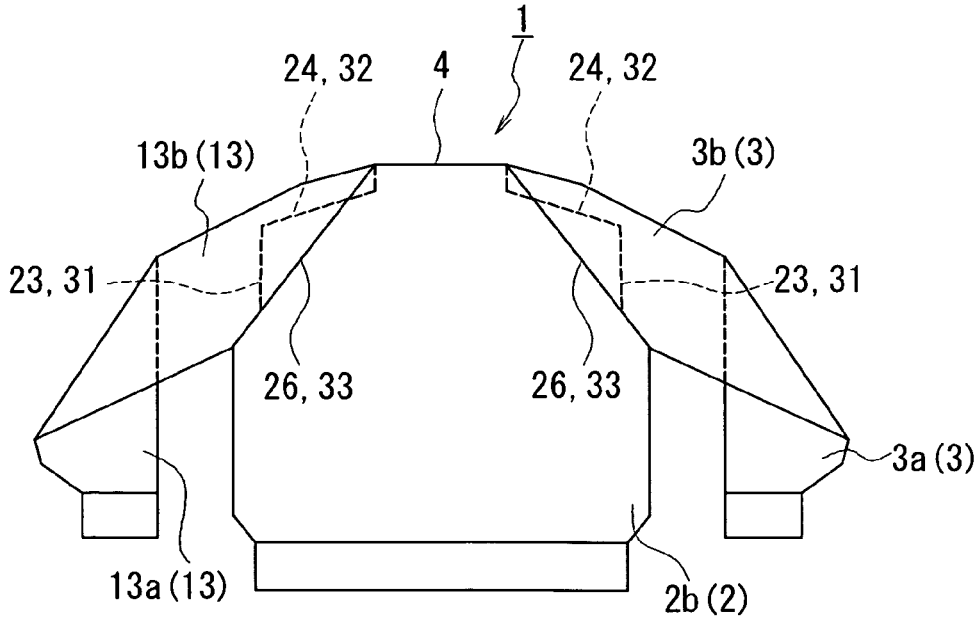
Fig. 1 (B)

KNITWEAR GARMENT AND METHOD OF KNITTING KNITWEAR

CROSS REFERENCE TO RELATED APPLICATION

This application is a 35 USC § 371 National Phase Entry Application from PCT/JP2004/000968, filed Jan. 30, 2004, and designating the United States.

TECHNICAL FIELD

The present invention relates to knitwear with sleeves and to a method of knitting the knitwear with sleeves. Particularly, the present invention relates to knitwear having a unique armhole shape for attaching sleeves and to a knitting method of the same.

BACKGROUND ART

In general, armhole shapes for attaching sleeves of knitwear are roughly classified into a set-in sleeve type one and a raglan sleeve type one, as shown in JP Examined Patent Publication No. Hei 4-15301 (Patent Document 1), and JP Laid-open (Unexamined) Patent Publication No. Hei-11-61603 (Patent Document 2), for example.

As for the set-in sleeve, as shown in FIG. 1 of Patent Document 1 and FIG. 1 of Patent Document 2, the front and back bodies are each knitted to have a hem part, side parts, armhole parts formed at upper ends of the side parts, and shoulder-line parts extending along one's shoulder line formed when wearing knitwear. The armhole parts are formed to have straight-line portions extending in the same direction as the side parts, from upper end portions of which the shoulder line parts extend toward a neckline. After the sleeves are jointed to the front and back bodies along their respective armhole parts, the shoulder-line parts of the front and back bodies are joined together.

As for the raglan sleeve, as shown in FIG. 4 of Patent Document 1 and FIG. 11 of Patent Document 2, the front and back bodies are each knitted to have a hem part, side parts, slant-line parts slanted linearly from upper ends of the side parts toward a neckline. The sleeves, which are knitted to cover one's arms and shoulder when wearing the knitwear, are joined to the slant-line parts of the bodies so that a part of the neckline can be formed by upper end portions of the sleeves.

Meanwhile, knitwear of combination of one body shaped for the set-in sleeve and the other body shaped for the raglan sleeve has never been proposed so far. The reasons for no existence of such designed knitwear of mixed sleeves are as follows.

For the set-in sleeve, the body is formed to have, at the armhole parts thereof, the straight-line portions extending in the same direction as the side parts, so that when joined to the straight-line portions of the body, the set-in sleeves are sequentially joined thereto to form right angle with the straight-line portions (Cf. FIG. 1 of Patent Document 2).

For the raglan sleeve, the body is formed to have the slant-line parts, so that when joined to the body, the raglan sleeves are sequentially joined to the slant-line parts of the body obliquely (Cf. FIG. 11 of Patent Document 2).

From comparison between the set-in sleeve and the raglan sleeve on a knitted fabric length of a joining portion of the sleeve to the body, it is found that the length of the slant-line parts for the raglan sleeve is larger than the length of the armhole parts for the set-in sleeve. Accordingly, the length of the joining portion of the sleeve joined to the body shaped for the raglan sleeve is also larger than that of the joining portion of the sleeve joined to the body shaped for the set-in sleeve.

Thus, the set-in sleeve and the raglan sleeve provide different lengths for the joining portion between the body and the sleeve. Due to this, when the one body shaped for the set-in sleeve and the other body shaped for the raglan sleeve are concurrently knitted with the same number of courses, the body shaped for the raglan sleeve cannot be coincidentally jointed to the sleeves due to the difference in length of the joining portion therebetween.

For the set-in sleeve, it is general that the body and the sleeves are often knitted with a ratio of the number of courses of the body knitted to the number of courses of the sleeve knitted of 2:1, when joined together. For the raglan sleeve, it is general that the body and the sleeves are often knitted with a ratio of the number of courses of the body knitted to the number of courses of the sleeve knitted of 1:1, when joined together.

When the front and back bodies, one of which is shaped for the set-in sleeve and the other of which is shaped for the raglan sleeve, and the sleeves are knitted with a ratio of the number of courses of the bodies knitted to the number of courses of the sleeves knitted of 2:1, the body on the raglan sleeve side is oversupplied with the number of stitches at the joining portion thereof.

When the front and back bodies and the sleeves are knitted with a ratio of the number of courses of the front body (set-in sleeve) knitted to the number of courses of the sleeve knitted of 2:1 and with a ratio of the number of courses of the back body (raglan sleeve) knitted to the number of courses of the sleeve knitted of 1:1, the number of courses of the sleeves knitted required for joining together a shoulder portion of the set-in sleeve and a sleeve portion of the raglan sleeve at the shoulder parts is determined and the number of courses of the back body knitted with the ratio of the number of courses of the back body knitted to the number of courses of the sleeve knitted of 1:1 is also determined.

Thus, regardless of the number of courses of the front body knitted, the number of courses of the back body knitted is determined, due to which the back body has an increased number of courses knitted over the front body and is put in oversupply.

For the reasons mentioned above, the knitwear of mixed set-in and raglan sleeves is not yet commercialized successfully.

DISCLOSURE OF THE INVENTION

In consideration of the circumstances mentioned above, the present invention has been developed. It is an object of the present invention to provide seamless knitwear of mixed set-in and raglan sleeves and a method of knitting the same knitwear.

The present invention provides seamless knitwear of mixed set-in and raglan sleeves. The knitwear of the present invention comprises a body and sleeves. One of front and back bodies of the body has armhole parts and shoulder-line parts extending along one's shoulder line formed when wearing the knitwear, and the other body has slant-line parts extending obliquely from the neckline to side parts of the body.

The front body and the back body are knitted in tubular form in a seamless manner, and the sleeves are knitted in tubular form in a seamless manner. Also, the sleeves are joined to the armhole parts, the shoulder-line parts, slant-line parts of the front and back bodies in a seamless manner, so that a neckline is formed by a part of the sleeves. As to the number of courses of the front and back bodies knitted in the course of joining of the sleeves to the armhole parts of the bodies, the number of courses knitted of the body having the slant-line parts is decreased below the number of courses of the body having the shoulder-line parts knitted.

As to the number of courses of front and back bodies knitted in the course of joining of the sleeves to the shoulder-line parts of the bodies, the number of courses of the body having the slant-line parts knitted is increased over the number of courses of the body having the shoulder-line parts knitted.

In this case, while parts of the sleeves to be joined to the shoulder-line parts are knitted with the number of courses knitted that can prevent shrink of the parts of the sleeves when joined to the shoulder-line parts, the parts of the sleeves and the shoulder-line parts are joined together. Further, a ratio of the number of courses for the sleeves and the body having the slant-line parts to be joined together to the number of courses for the sleeves and the body having the slant-line parts to be knitted is set so that when the sleeves and the body having the slant-line parts are joined together to match with each other between the starting locations and the ending locations for joining them together, no slack is produced in the joining parts of the sleeves and the body having the slant-line part, so that the sleeves and the body are joined together in such a ratio. It should be noted that the shoulder line formed when a wearer wears the knitwear is determined with reference to a body shape of the wearer who wears the knitwear.

The body having the armhole parts and the shoulder-line parts extending along one's shoulder line formed when wearing the knitwear is a so-called set-in sleeve use body.

The body shaped for the set-in sleeve is knitted to have a hem part, side parts, armhole parts formed to extend from upper ends of the side parts, and shoulder-line parts extending along one's shoulder line formed when wearing the knitwear. The armhole parts have straight-line parts extending in the same direction as the side parts, and the shoulder-line parts are formed to extend from upper ends of the straight-line parts toward the neckline.

The shoulder-line parts may be formed to extend in parallel with the hem part and extend orthogonally to the straight-line parts of the armhole parts, or may alternatively be formed to slant with respect to the hem part so as to form shoulder drops.

The body having slant-line parts extending obliquely from the neckline to the side parts of the body is a so-called raglan-sleeve use body.

The body shaped for the raglan sleeve is knitted to have a hem part, side parts, and slant-line parts formed to extend obliquely and substantially linearly from upper ends of the side parts toward the neckline.

Further, it is preferable that knitting parts of the sleeves are knitted to have, at parts thereof joined to the body, armhole-part joining parts to be joined to the armhole parts, shoulder-line-part joining parts, extending continuously to the armhole-part joining parts, to be jointed to the shoulder-line parts, slant-line-part joining parts to be jointed to the slant-line parts, and neckline forming parts formed between upper ends of the slant-line-part joining parts and upper ends of the shoulder-line-part joining parts.

Concretely, one body is formed so that the shoulder-line parts can be located below the shoulder line formed by one's shoulder line when wearing the knitwear.

When the sleeves are divided into two halves of the front-body-side sleeve and the back-body-side sleeve, the knitting parts of the sleeve are formed as described below at parts thereof joined to the body. The knitting parts of the sleeve on the side thereof joined to the shoulder-line parts have trapezoidal knitting parts having armhole-part joining parts and rectangular knitting parts formed above and continuous with the trapezoidal knitting parts and having shoulder-line-part joining parts. In this formation, when the joining of the rectangular knitting parts to the shoulder-line parts is ended, upper ends of the rectangular knitting parts form a part of the neckline.

Also, the knitting parts of the sleeve on the side thereof joined to the slant-line parts have triangular knitting parts joined to the slant-line parts. The trapezoidal knitting parts and the rectangular knitting parts are knitted to be continuous with the triangular knitting parts.

As a result of the sleeves being knitted in this manner, when the wearer wears the knitwear, his/her shoulder is covered with a part of the sleeves.

Further, the number of courses of the front and back bodies knitted in the course of joining of the sleeves to the armhole parts of the bodies is set so that when the sleeves are joined to the armhole parts, the number of courses knitted of the body having the shoulder-line parts is decreased below the number of courses knitted of the body having the slant-line parts. Also, the number of courses of the front and back bodies knitted in the course of joining of the sleeves to the shoulder-line parts of the bodies is set so that when the sleeves are joined to the shoulder-line parts, the number of courses knitted of the body having the shoulder-line parts is increased over the number of courses knitted of the body having the slant-line parts.

When the sleeves are joined to the shoulder-line parts, the sleeves are joined thereto while being knitted with the number of courses knitted that can prevent formation of shrink in the sleeves when joined to the shoulder-line parts. Then, a ratio of the number of courses for the sleeves and the body having the slant-line parts to be joined together to the number of courses knitted of the sleeves and the body having the slant-line parts is set so that when the sleeves and the body having the slant-line parts are joined together to match with each other between the starting locations and the ending locations for joining them together, no slack is produced in the joining parts of the sleeves and the body having the slant-line part, so that the sleeves are joined to the body in such a ratio.

Concretely, when the sleeves are joined to the shoulder-line parts, a number of courses knitted required for the sleeves to be joined to the shoulder-line parts is determined according to lengths of the shoulder lines. Then, the total number of courses of the front and back bodies knitted from the start of joining of the sleeves and the body to the end of the joining is also determined from the shapes of the front and back bodies.

Referring now to the body having the slant-line parts, the number of remaining courses to be knitted in the 4th step mentioned later can be calculated by subtracting the number of courses already knitted in the 3rd step mentioned later from the total number of courses knitted.

When the sleeves are joined to the shoulder-line parts, with reference to the number of remaining courses of the body thus calculated and the number of courses knitted of the sleeves, the ratio of the number of courses of the sleeves to the number of courses knitted of the body having the slant-line parts is determined so that the sleeves and the body having the slant-line parts can be joined together to match with each other between the starting locations and the ending locations for joining together the sleeves and the body having the slant-line parts and also the joining parts of the sleeves and the body can be prevented from being slackened.

Since the knitwear of the present invention is knitted in the manner described above, the seamless knitwear of mixed set-in and raglan sleeves can be formed without any slack being produced in one of the front and back bodies.

Also, the present invention can provide a knitwear knitting method described below, in order that knitwear of mixed set-in and raglan sleeves can be knitted without any need of sewing operations.

The present invention provides a method of knitting knitwear with sleeves formed by using a flat knitting machine having at least a pair of front and back needle beds extending in a transverse direction and disposed opposite to each other in a cross direction, at least either of which is capable of being racked in the transverse direction so that loops can be transferred between the front and back needle beds.

The method comprising the following steps for forming armhole parts and shoulder-line parts extending along one's shoulder line formed when wearing the knitwear in any one of a front body and a back body and also forming slant-line parts extending obliquely from a neckline to side parts of the body:

1) the first step of knitting the front body and the back body in tubular form from their hem parts to starting locations for joining the body and the sleeves and knitting the sleeves in tubular form from their sleeve cuff parts, 2) the second step of joining the sleeves to the armhole parts and the slant-line parts, while knitting the front and back bodies and the sleeves with the same number of courses knitted from starting locations for the body and the sleeves to be joined together to locations on the armhole parts, 3) the third step of increasing the number of courses knitted of the body having the shoulder-line parts over the number of courses knitted of the body having the slant-line parts from locations at which the knitting of the armhole parts starts after the second step to locations at which the knitting of the shoulder-line parts start and also joining the sleeves to the armhole parts and the slant-line parts, while the sleeves are knitted, and 4) the fourth step of joining the bodies to the sleeves, while the body having the slant-line parts is knitted with an increased number of courses over the number of courses knitted of the body having the shoulder-line parts and also the sleeve parts joined to the shoulder-line parts are knitted with the number of courses knitted that can prevent formation of slack in the sleeves joined to the shoulder-line parts, and also setting a ratio of the number of courses for the sleeves and the body having the slant-line parts to be joined together to the number of courses knitted of the sleeves and the body having the slant-line parts so that when the sleeves and the body having the slant-line parts are joined together to match with each other between the starting locations and the ending locations for joining them together, no slack is produced in the joining parts of the sleeves and the body having the slant-line part, whereby the sleeves are joined to the shoulder-line parts and the slant-line parts in such a ratio, while the sleeves are knitted.

In the first step, the knitting of the front body and the back body in tubular form and the knitting of the sleeves in tubular form are performed concurrently.

In the second step, the body and the sleeves are joined together, while being knitted with the number of stitches being gradually decreased.

In the third step, the body having the shoulder-line parts is knitted without increasing or decreasing the number of stitches (wales) at the armhole forming parts thereof. The knitting parts of the sleeves (the trapezoidal knitting parts) on the side thereof joined to the armhole parts are joined to the armhole parts, while being knitted with the number of stitches being gradually decreased.

In the third step, the body having the slant-line parts is knitted, while the number of stitches on the side thereof joined to the sleeves is gradually decreased for each predetermined course. The knitting parts of the sleeves (the triangular knitting parts) on the side thereof joined to the slant-line parts are also gradually decreased in number of stitches so that the number of times the side thereof joined to the slant-line parts is decreased in number of stitches below the slant-line-part side can be increased.

Further, in the third step, the body having the shoulder-line parts and the body having the slant-line parts are preferably knitted to be in the number-of-course-knitted ratio of 2:1. The body may be knitted with said number-of-course-knitted ratio and an alternate number-of-course-knitted ratio (e.g. 2:1 and 1:1) being repeated in an alternate order, depending on the shape of the body.

Also, in the third step, the body having the shoulder-line parts, the body having the slant-line parts, and the sleeves are preferably knitted to be in the number-of-course-knitted ratios of 4:3:2.

Since the number of courses knitted of the body on the slant-line-part side is decreased below that of the body on the armhole-part side in the third step, when the body and the sleeves are joined together, no slack is produced in the one body.

In the fourth step, when the shoulder drop is formed in the body having the shoulder line parts, the body is knitted to form the shoulder line parts, with the number of stitches on the side thereof joined to the sleeves being gradually decreased. On the other hand, when the shoulder drop is not formed therein, the stitches are held on the needles without being knitted. The knitting parts of the sleeves (the rectangular knitting parts) on the side thereof joined to the shoulder-line parts are knitted in rectangle form without increasing or decreasing the stitches (wales) and are sequentially joined to the shoulder-line parts.

In the fourth step, the body having the slant-line parts is knitted, while the number of stitches on the side thereof joined to the sleeves is gradually decreased for each predetermined course, as is the case with the third step. The knitting parts of the sleeves (the triangular knitting parts) on the side thereof joined to the slant-line parts are also gradually decreased in number of stitches so that the number of times the side thereof joined to the slant-line parts is decreased in number of stitches below the slant-line-part side can be increased.

Further, in the fourth step, the body having the shoulder-line parts and the body having the slant-line parts are preferably knitted to be in the number-of-course-knitted ratio of e.g. 1:2. The body may be knitted with said number-of-course-knitted ratio and an alternate number-of-course-knitted ratio (e.g. 1:2 and 1:1) being repeated in an alternate order, depending on the shape of the body.

When the shoulder drop is not formed in the body, the number of courses knitted of the body having the shoulder-line parts is zero, so that only the body having the slant-line parts is knitted. In the fourth step, while the body having the slant-line parts is knitted, the sleeves are also knitted.

Further, in the fourth step, the sleeve parts joined to the shoulder-line parts are joined to the shoulder-line parts, while being knitted with the number of courses knitted that can prevent shrink of the sleeves when joined to the shoulder-line parts. Then, the sleeves and the body having the slant-line parts are joined together so that a ratio of the number of courses for the sleeves and the body having the slant-line parts to be joined together to the number of courses of the sleeves and the body knitted can be set so that when the sleeves and the body having the slant-line parts are joined together to match with each other between the starting locations and the ending locations for joining them together, no slack is produced in the joining parts of the sleeves and the body having the slant-line parts.

In the fourth step, before knitting, a number of courses knitted required for the sleeves to be joined to the shoulder line parts is determined according to lengths of the shoulder lines, and the total number of courses of the front and back bodies knitted from the start of joining of the sleeves and the body to the end of joining is also determined from the shapes of the front body and the back body.

As to the body having the slant-line parts, the number of remaining courses to be knitted in the fourth step can be calculated by subtracting the number of courses already knitted in the third step from the total number of courses knitted.

In the fourth step, with reference to the number of remaining courses of the body and the number of courses of the sleeves knitted, the ratio of the number of courses of the sleeves to the number of courses of the body having the slant-line parts knitted is determined. This ratio is set so that the sleeves and the body having the slant-line parts can match with each other between the starting locations and the ending locations of the sleeves and the body having the slant-line parts and also the joining parts of the sleeves and the body having the slant-line parts can be prevented from being slackened. The sleeves and the body are sequentially joined together in this ratio.

In the fourth step, the difference in number of stitches between the front and back bodies, which was caused by decreasing the number of courses knitted of the body having the slant-line parts below the number of courses knitted of the body having the shoulder-line parts in the third step, can be made up by increasing the number of courses knitted of the body having the slant-line parts over the number of courses of the body having the shoulder-line parts in the fourth step.

Further, when the joining of the sleeves to the front and back bodies is ended, a part of the neckline is formed by upper ends of the rectangular knitting parts. The neckline parts of the rectangular knitting parts and the neckline parts formed in the front and back bodies are continuously joined together and thereby the neckline is formed.

According to the present invention, the knitwear can be knitted so that the set-in sleeve is formed in the front body and the raglan sleeve is formed in the back body. Alternatively, the knitwear may be knitted so that the raglan sleeve is formed in the front body and the set-in sleeve is formed in the back body.

As mentioned above, the present invention can provide seamless knitwear of mixed set-in and raglan sleeves without any slack being formed in one of the bodies.

In the knitting method of the present invention, since the number of courses knitted of the body on the slant-line-part side is decreased below that of the body on the armhole-part side in the third step, when the body and the sleeves are joined together, no slack is produced in the one body.

Further, in the fourth step, the difference in number of stitches between the front and back bodies, which was caused by decreasing the number of courses knitted of the body having the slant-line parts below the number of courses knitted of the body having the shoulder-line parts in the third step, can be made up by increasing the number of courses knitted of the body having the slant-line parts over the number of courses of the body having the shoulder-line parts in the fourth step.

Further, in the fourth step, the sleeve parts joined to the shoulder-line parts are joined to the shoulder-line parts, while being knitted with the number of courses knitted that can prevent shrink of the sleeves when joined to the shoulder-line parts. In addition, a ratio of the number of courses for the sleeves and the body having the slant-line parts to be joined together to the number of courses of the sleeves and the body knitted is set so that when the sleeves and the body having the slant-line parts are joined together to match with each other between the starting locations and the ending locations for joining them together, no slack is produced in the joining parts of the sleeves and the body having the slant-line parts. The sleeves are joined to the shoulder-line parts and the slant-line parts, while being knitted in this ratio. Therefore, even when the body and the sleeves are joined together, the one body can be prevented from being slacked and the other body can be prevented from being shrunk.

As described above, according to the knitting method of the present invention, the seamless knitwear of mixed set-in and raglan sleeves can be knitted without forming any slack in the one body.

BRIEF DESCRIPTION OF THE DRAWINGS

FIG. 1 shows an embodiment of knitwear according to the present invention, (a) showing a front view of a sweater as viewed from a front body side, and (b) showing a rear view of the same as viewed from a back body side.

BEST MODE FOR CARRYING OUT THE INVENTION

An embodiment on knitwear with sleeves and an embodiment on a method thereof according to the present invention will be described with reference to the accompanying drawings.

In the illustrated embodiment, knitwear is knitted using a so-called two-bed flat knitting machine comprising a pair of front and back needle beds extending in a transverse direction and disposed opposite to each other in a cross direction, the back needle bed being capable of being racked so that loops can be transferred between the front and back needle beds.

In the two-bed flat knitting machine, alternate needles on each of the front and back needle beds are used to knit a tubular knitwear. For example, odd needles of the front needle bed are used mainly for knitting front parts of the knitwear, such as the front body and front parts of the sleeves, and even needles of the back needle bed are used mainly for knitting back parts of the knitwear, such as the back body and back parts of the sleeves.

Further, needles on one of the front and back needle beds which confront the knitting needles on the other needle bed are used as empty needles. The empty needles are used for transference of loops and for the rib knitting and the like.

Using the empty needles can allow a structure pattern of mixed front and back stitches, such as links, purl stitches, and ribs to be knitted and can also allow the loops of the sleeves and the bodies to move in a direction of course so as to join them to each other.

When the two-bed flat knitting machine is used, a transfer jack bed arranging transfer jacks thereon may be disposed over either or both of the front and back needle beds, to knit a knitted fabric.

In the illustrated embodiment, the two-bed flat knitting machine is used to knit knitwear. According to the present invention, a four-bed flat knitting machine comprising an upper front needle bed, a lower front needle bed, an upper back needle bed, and a lower back needle bed may alternatively be used to knit the knitwear.

When the four-bed flat knitting machine is used to knit knitwear, for example front knitted fabric parts are supplied to the lower front needle bed, and back knitted fabric parts are supplied to the lower back needle bed. Then, when knitting the front knitted fabric parts, the needles of the upper back needle bed are used as empty needles for transference of loops of the front knitted fabric parts. When knitting the back knitted fabric parts, needles of the upper front needle bed are used as empty needles for transference of loops of the back knitted fabric parts.

Illustrated in this embodiment are a method of knitting bodies and sleeves of knitwear seamlessly using a two-bed flat knitting machine so that the bodies and the sleeves can be formed into a seamless and continuous tubular form and knitwear knitted by the same knitting method.

Figure 4:
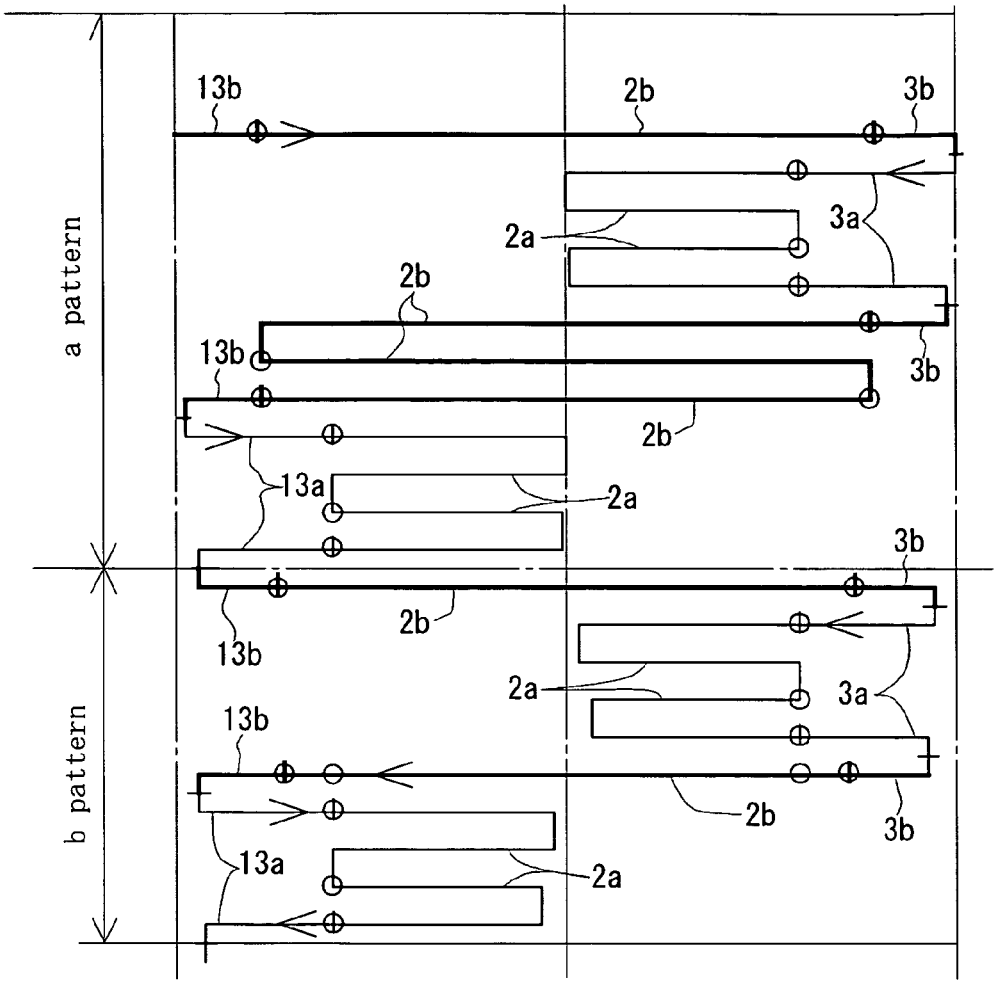
FIG. 4 shows a knitting process drawing of the third step of a knitwear knitting method of the present invention.
Figure 5:
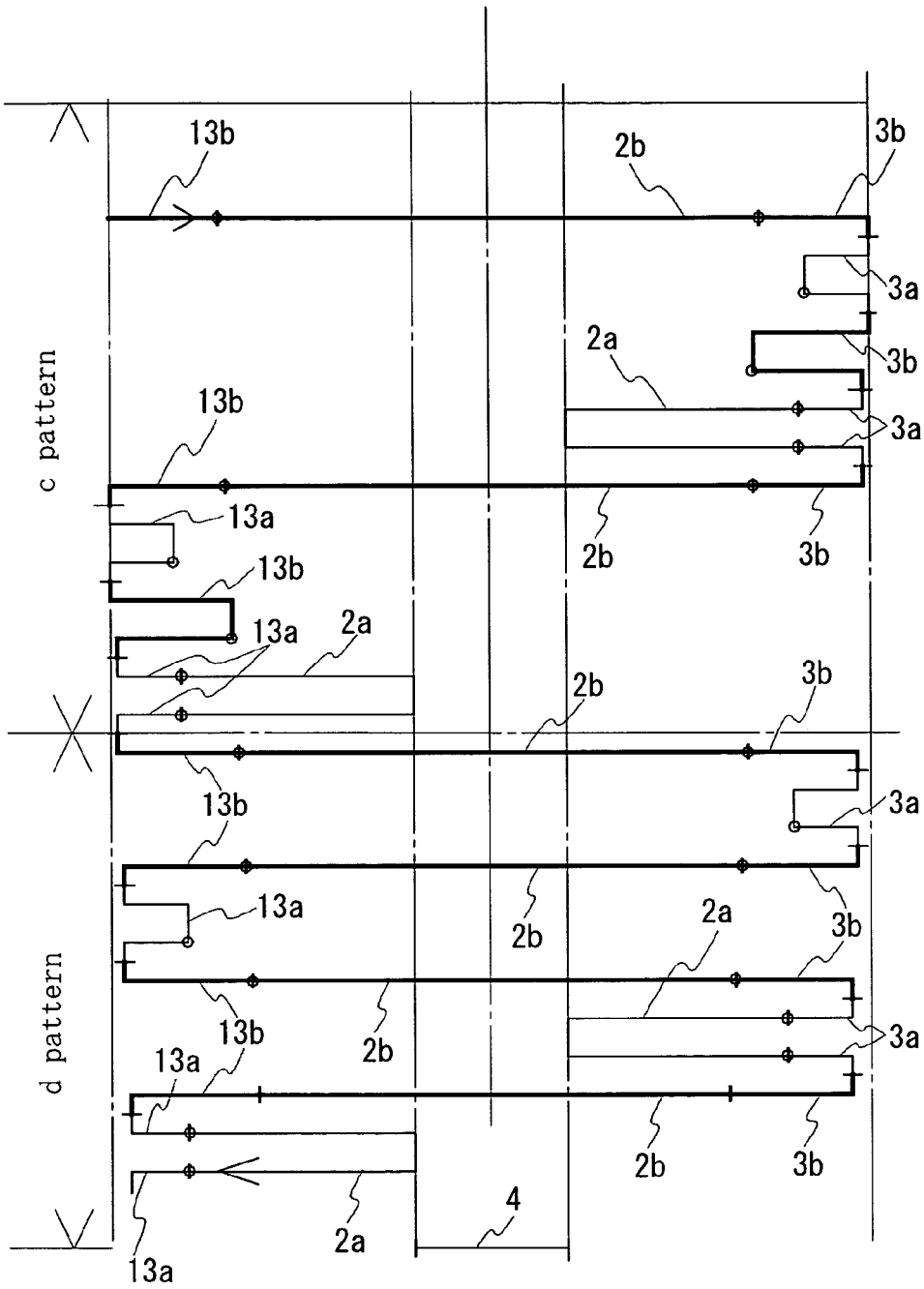
FIG. 5 shows a knitting process drawing of the fourth step of the knitwear knitting method of the present invention.

An embodiment of the present invention is explained with reference to FIG. 1 to FIG. 5. In FIGS. 4 and 5, open circles on a line representing a sequence of knitting actions indicate locations where a narrowing stitch of the body or the sleeve is performed.

A sweater 1 knitted in this embodiment is a long sleeved sweater having a V-necked neckline. The sweater 1 of this embodiment has a body 2, a left sleeve 3, a right sleeve 13, and a neckline 4.

Figure 2:
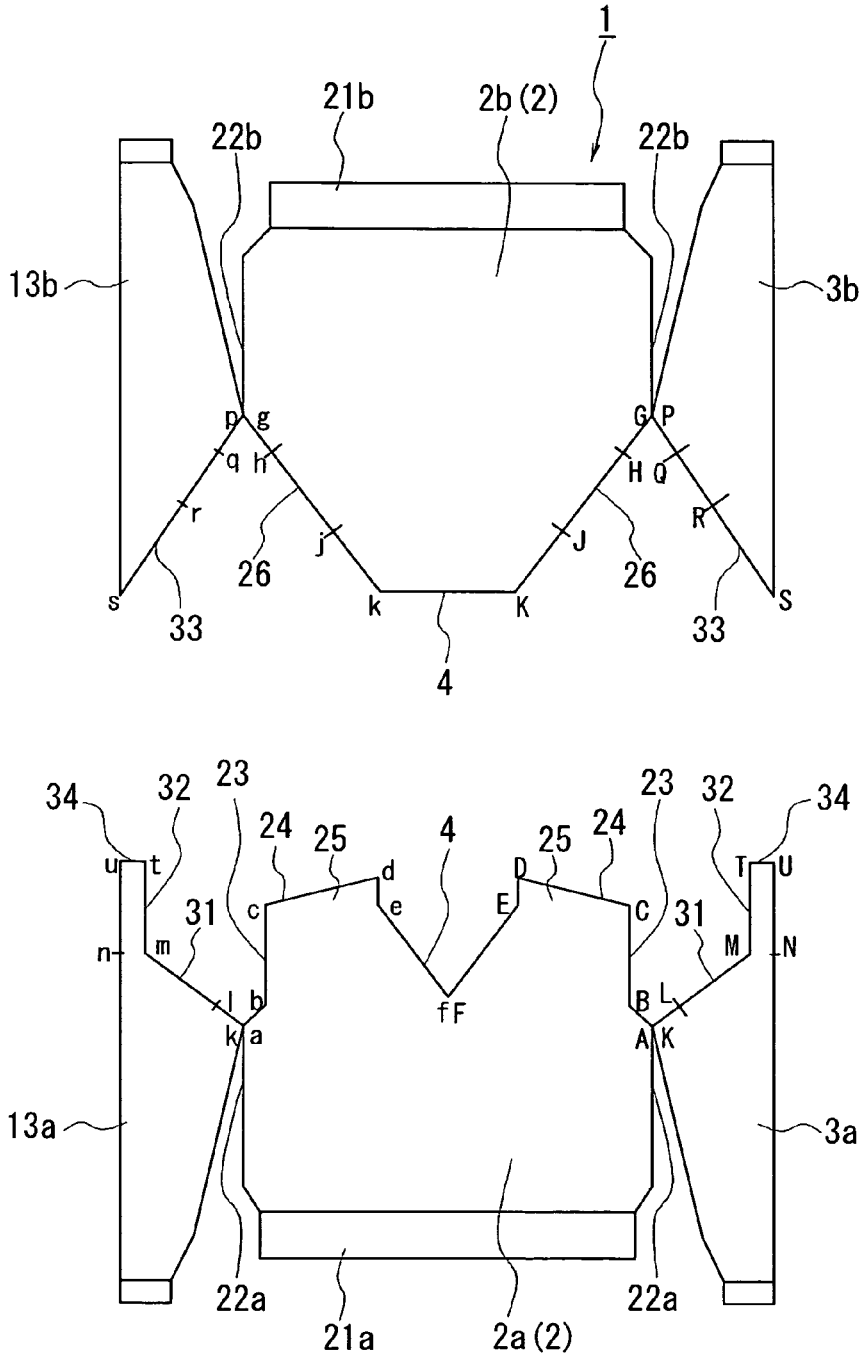
FIG. 2 shows the embodiment of the knitwear according to the present invention, showing the state of parts of the sweater being to be knitted on a flat knitting machine.

A front body 2*a* and a back body 2*b* are different in shape at their parts located above the points A, a, G, g in FIG. 2 at which the joining of the sleeves to the bodies starts.

The front body 2*a* has a hem part 21*a*, side parts 22*a*, armhole parts 23, and shoulder-line parts 24, as shown in FIG. 2. The front body 2*a* is a so-called set-in sleeve use body.

The armhole parts 23 are formed from upper ends of the side parts 22*a*, 22*b* (locations A, a of FIG. 2) and have straight-line parts (B–C, b–c of FIG. 2) extending in the same direction as the side parts. The shoulder-line parts 24 are formed from upper ends of the straight-line parts (locations C, c of FIG. 2) toward the neckline 4. The shoulder-line parts 24 are formed along one's shoulder line formed when wearing the knitwear. The shoulder-line parts 24 are slanted downwardly from the neckline 4, with shoulder-drop knitting parts 25 formed at the shoulder parts of the front body 2*a*. Further, the front body 2*a* is formed so that the shoulder-line parts 24 can be located below one's shoulder line formed when wearing the knitwear.

The back body 2*b* has a hem part 21*b*, side parts 22*b*, and slant-line parts 26 extending obliquely from the neckline 4 (locations K, k of FIG. 2) to side parts of the body (locations G, g of FIG. 2), as shown in FIG. 2. The back body 2*b* is a so-called raglan sleeve use body.

Figure 3:
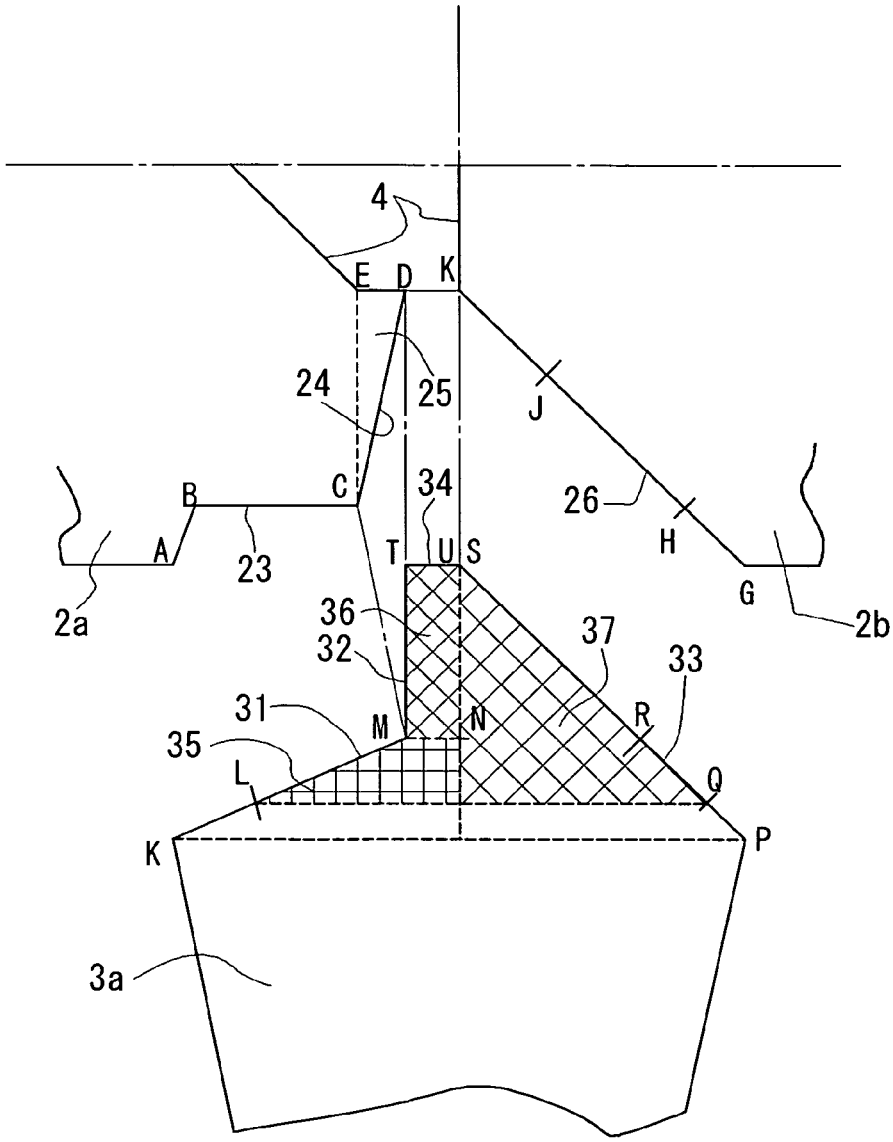
FIG. 3 shows the embodiment of the knitwear according to the present invention, showing a partly enlarged view of the respective parts of joining portions of the front and back bodies to the sleeves.

Knitting parts of the right and left sleeves 3, 13 have, at joining parts thereof to the body 2, armhole-part joining parts 31 to be joined to the armhole parts 23, shoulder-line-part joining parts 32 to be jointed to the shoulder-line parts 24, slant-line-part joining parts 33 to be jointed to the slant-line parts 26, and neckline forming parts 34, as shown in FIGS. 2 and 3.

The shoulder-line-part joining parts 32 are formed to extend continuously from the armhole-part joining parts 31. The neckline forming parts 34 are formed between upper ends of the slant-line-part joining parts 33 and upper ends of the shoulder-line-part joining parts 32.

Further, knitting parts of the right and left sleeves 3, 13 have, at joining parts thereof to the body 2, trapezoidal knitting parts 35 having the armhole-part joining parts 31, rectangular knitting parts 36 having the shoulder-line-part joining parts 32, and triangular knitting parts 37 having the slant-line-part joining parts 33, as shown in FIG. 3.

Each rectangular knitting part 36 is knitted to extend upwardly from and continuously with the trapezoidal knitting part 35. The trapezoidal knitting part 35 and the rectangular knitting part 36 are knitted to extend continuously with the triangular knitting part 37 with respect to a transverse direction. The upper end of the rectangular knitting part 36, when joined to the shoulder-line part 24, forms a part of the neckline forming part 34.

In the illustrated embodiment, the front body 2*a* and the back body 2*b* are knitted in tubular form in a seamless manner and the sleeves 3, 13 are also knitted in tubular form in a seamless manner. The sleeves 3, 13 are joined to the front body 2*a* at the armhole parts 23 and the shoulder-line parts 24 in a seamless manner and to the back body 2*b* at the slant-line parts 26 in a seamless manner.

When the sleeves 3, 13 are sequentially joined to the body 2, the number of courses of the front body 2*a* and the back body 2*b* to be knitted when the sleeves 3, 13 are joined to the armhole parts 23 of the front body 2*a* are provided in such a manner that the number of courses of the back body 2*b* knitted can be decreased below the number of courses of the front body 2*a* knitted. The number of courses of the front body 2*a* and the back body 2*b* to be knitted when the sleeves 3, 13 are joined to the shoulder-line parts 24 of the front body 2*a* are provided in such a manner that the number of courses of the back body 2*b* knitted can be increased over the number of courses of the front body 2*a* knitted.

After completion of the joining of the sleeves 3, 13 and the body 2, a part of the neckline 4 is formed by the neckline forming parts 34.

In the illustrated embodiment, the terms, "right" and "left", used for the body and the sleeves and for the shoulder line, like the left sleeve 3 and the right sleeve 13, indicate the right-hand side and the left-hand side of the knitwear as viewed from a wearer who wears the sweater 1.

Next, the steps for knitting the sweater 1 of this embodiment are described. In this embodiment, the back body 2*b*, the right back sleeve 13*b*, and the left back sleeve 3*b* are knitted mainly with odd needles on the back needle bed, and the front body 2*a*, the right front sleeve 13*a*, and the left front sleeve 3*a* are knitted mainly with even needles on the front needle bed.

For convenience of explanation, the front body 2*a*, the back body 2*b*, and the sleeves 3, 13 of the sweater 1 are knitted in a plain knitting pattern, and the hem parts of the body 2 and sleeve cuff parts of the sleeves 3, 13 are knitted in a rib knitting pattern. Alternatively, the front body 2*a*, the back body 2*b* and the sleeves 3, 13 may be knitted in a jacquard knitting pattern or a rib knitting pattern.

First, a tubular body and tubular right and left sleeves are knitted by repetition of the knitting step of feeding a knitting yarn to the needles for knitting the front body from a body knitting use yarn feeder (not shown) and then feeding the knitting yarn therefrom to the needles for knitting the back body, while reversing the yarn feeder, and by repetition of the same knitting steps using a sleeve knitting use yarn feeder (not shown).

To be more specific, the front body 2*a* and the back body 2*b* are knitted in tubular form from their hem parts to starting locations (A, a, G, g) for joining to the sleeves. The left front sleeve part 3*a* and the left back sleeve part 3*b* are knitted in tubular form from the sleeve cuff parts to the starting locations (K, P) for joining to the body. The right front sleeve part 13*a* and the right back sleeve part 13*b* are knitted in tubular form from the sleeve cuff parts to the starting locations (k, p) for joining to the body (1st step). The hem parts of the body and the sleeve cuff parts are knitted by rib knitting.

In the sweater 1, the front body 2*a* at the locations A, a are joined to the left front sleeve part 3*a* at the location K and the right front sleeve part 13*a* at the location k, and the back body 2*b* at the locations G, g are joined to the left back sleeve part 3*b* at the location P and the right back sleeve part 13*b* at the location p. When the body 2 and the left and right sleeves 3, 13 start being joined together, the body 2 and the left and right sleeves 3, 13 are combined to form a single tubular body.

From the starting locations (A–K, a–k, G–P, g–p) for joining together the body 2 and the sleeves 3, 13 to locations (B, b) on the armhole parts 23 and locations (H, h) on the slant-line parts 26, the front body 2*a*, the back body 2*b*, and the sleeves 3, 13 are knitted with the same number of courses knitted, while the sleeves 3, 13 are joined to the armhole parts 23 and the slant-line parts 26 (2nd step).

In the 2nd step, the left sleeve 3 is knitted to L–Q and the right sleeve 13 is knitted to l–q. Further, in the 2nd step, the front body 2*a*, the back body 2*b*, and the sleeves 3, 13 are all gradually decreased in number of stitches at their joining parts.

Then, after the 2nd step, from the locations (B, b) on the armhole parts 23 to starting locations (C, c) for forming the shoulder-line parts 24, the front body 2*a* and the back body 2*b* are knitted so that the number of courses of the front body 2*a* knitted can be increased over the number of courses of the back body 2*b* knitted. In parallel with this, the sleeves 3, 13 are knitted, while the sleeves 3, 13 are joined to the armhole parts 23 and the slant-line parts 26 (3rd Step).

After the neckline 4 starts being formed in the front body 2*a*, the body 2 and the sleeves 3, 13 are knitted by a process of sequentially knitting a left-side part of the front body 2*a*, the left front sleeve part 3*a*, the left back sleeve part 3*b*, the back body 2*b*, the right back sleeve part 13*b*, the right front sleeve part 13*a*, and a right-side part of the front body 2*a*, followed by the knitting of those in the reverse sequence. Then, while they are knitted in this manner, the front body 2*a* and the left front sleeve part 3*a* are joined together; the left back sleeve part 3*b* and the right back sleeve part 13*b* are joined to the back body 2*b*; and the front body 2*a* and the right front sleeve part 13*a* are joined together.

The knitting of the 3rd step is explained concretely with reference to FIG. 4. In FIG. 4, the back body 2*b*, the left back sleeve part 3*b*, and the right back sleeve part 13*b* are depicted by a thick line, and the front body 2*a*, the left front sleeve part 3*a*, and the right front sleeve part 13*a* are depicted by a thin line. FIG. 4 shows the state in which the neckline 4 has just started being formed in the front body 2*a*.

In the 3rd step, the knitting proceeds by repeating the knitting of an "a" pattern and the knitting of a "b" pattern in an alternate order, or repeating only the knitting of the "b" pattern several times in the course of the alternate repetition of the a•b patterns.

In the knitting of the "a" pattern, the back parts of the sweater are knitted one course by sequentially knitting the right back sleeve part 13*b*, the back body 2*b*, and the left back sleeve part 3*b*, first, and, then, the left front sleeve part 3*a* is knitted one course. Then, after the left half of the front body 2*a* is knitted four courses in total by a flechage knitting, the left front sleeve part 3*a* is knitted one course. Then, the left back sleeve part 3*b* is knitted one course. Then, after the back body 2*b* is knitted three courses by the flechage knitting, the right back sleeve part 13*b* is knitted one course. Then, the right front sleeve part 13*a* is knitted one course. Then, after the right half of the front body 2*a* is knitted four courses in total by the flechage knitting, the right front sleeve part 13*a* is knitted one course. After the processes described above, the knitting of the "a" pattern is ended.

In the knitting of the "a" pattern, a ratio of the number of courses of the front body 2*a* knitted to the number of courses of the back body 2*b* knitted is 1:1; a ratio of the number of courses of the front body 2*a* knitted to the number of courses of the front sleeve parts 3*a*, 13*a* knitted is 2:1; and a ratio of the number of courses of the back body 2*b* knitted to the number of courses of the back sleeve parts 3*b*, 13*b* is 2:1.

In the knitting of the "b" pattern, the back parts of the sweater are knitted one course by sequentially knitting the right back sleeve part 13*b*, the back body 2*b*, and the left back sleeve part 3*b*, first, and, then, the left front sleeve part 3*a* is knitted one course. Then, after the left half of the front body 2*a* is knitted four courses in total by the flechage knitting, the left front sleeve part 3*a* is knitted one course. Then, after the back parts are knitted one course by sequentially knitting the left back sleeve part 3*b*, the back body 2*b*, and the right back sleeve part 13*b*, the right front sleeve part 13*a* is knitted one course. Then, after the right half part of the front body 2*a* is knitted four courses in total by the flechage knitting, the right front sleeve part 13*a* is knitted one course. After the processes described above, the knitting of the "b" pattern is ended.

In the knitting of the "b" pattern, the ratio of the number of courses of the front body 2*a* knitted to the number of courses of the back body 2*b* knitted is 2:1; the ratio of the number of courses of the front body 2*a* knitted to the number of courses of the front sleeve parts 3*a*, 13*a* knitted is 2:1; and the ratio of the number of courses of the back body 2*b* knitted to the number of courses of the back sleeve parts 3*b*, 13*b* is 1:1.

In the 3rd step, the trapezoidal knitting part 35 having the armhole-part joining part 31, and a part of the triangular knitting part 37 having the slant-line-part joining part 33 are knitted in the sleeve 3(13), as shown in FIG. 3. Further, in the 3rd step, the back body 2*b* and the sleeves 3, 13 are gradually decreased in number of stitches at ends thereof on the side on which the body and the sleeves are joined together so that the number of stitches of the front body 2*a* can have the same wale at ends thereof on the side on which the body and the sleeves are joined together.

The 3rd step can provide the result that even when a ratio of the number of courses of the front body 2*a* knitted to the number of courses of the front sleeve parts 3*a*, 13*a* knitted is 2:1 and a ratio of the number of courses of the back body 2*b* knitted to the number of courses of the back sleeve parts 3*b*, 13*b* knitted is 3:2, since the back body 2*b* is smaller in number of courses knitted than the front body 2*a*, the back body 2*b* can be prevented from being oversupplied when the body 2 and the sleeves 3, 13 are joined together.

After the 3rd step of joining together the sleeves 3, 13 and the body 2 proceeds to the starting locations (C, c) of the shoulder-line part 24, the 4th step proceeds.

In the 4th step, the sleeves are joined to the shoulder-line parts, while the number of courses of the back body 2*b* knitted is increased over the number of courses of the front body 2*a* knitted and also the sleeves to be joined to the shoulder-line parts are knitted with the number of courses knitted that can prevent shrink of the sleeves when joined to the shoulder-line parts. Further, a ratio of the number of courses for the sleeves 3, 13 and the back body 2*a* to be joined together to the number of courses of the sleeves 3, 13 and the back body 2*b* knitted is set so that when the sleeves 3, 13 and the back body 2*b* are joined together to match with each other between the starting locations and the ending locations for joining them together, no slack is produced in the joining parts of the sleeves 3, 13 and the back body 2*b*. While the sleeves 3, 13 are knitted in such a ratio, the sleeves 3, 13 are joined to the shoulder-line parts 24 and the slant-line parts 26.

Further, the knitting of the 4th step is explained concretely with reference to FIG. 5. In FIG. 5, the back body 2*b*, the left back sleeve part 3*b*, and the right back sleeve part 13*b* are depicted by the thick line, and the front body 2*a*, the left front sleeve part 3*a*, and the right front sleeve part 13*a* are depicted by the thin line. FIG. 5 shows the state in which the shoulder drop knitting parts 25 has just started being formed in the front body 2*a*.

In the 4th step, the knitting proceeds by repeating the knitting of a "c" pattern and the knitting of a "d" pattern in an alternate order, or repeating only the knitting of the "d" pattern several times in the course of the alternate repetition of the c•d patterns.

In the knitting of the "c" pattern, the back parts of the sweater are knitted one course by sequentially knitting the right back sleeve part 13*b*, the back body 2*b*, and the left back sleeve part 3*b*, first, and, then, the left front sleeve part 3*a* is knitted two courses by the flechage knitting and the left back sleeve part 3*b* is knitted two courses by the flechage knitting. Then, after the left front sleeve part 3*a* and the left half of the front body 2*a* is knitted one course and then flechaged. Then, the left half of the front body 2*a* and the left front sleeve part 3*a* are knitted one course. Then, the back parts of the sweater are knitted one course by sequentially knitting the left back sleeve part 3*b*, the back body 2*b*, and the right back sleeve part 13*b*, first, and, then, the right front sleeve part 13*a* is knitted two courses by the flechage knitting. Then, the right back sleeve part 13*b* is knitted two courses by the flechage knitting. Then, the right front sleeve part 13*a* and the right half of the front body 2*a* are knitted one course and then flechaged. Then, the right half of the front body 2*a* and the right front sleeve part 13*a* are knitted one course. After the processes described above, the knitting of the "c" pattern is ended.

In the knitting of the "c" pattern, the ratio of the number of courses of the front body 2*a* knitted to the number of courses of the back body 2*b* knitted is 1:1; the ratio of the number of courses of the front body 2*a* knitted to the number of courses of the front sleeve parts 3*a*, 13*a* knitted is 1:2; and the ratio of the number of courses of the back body 2*b* knitted to the number of courses of the back sleeve parts 3*b*, 13*b* is 1:2.

In the knitting of the "d" pattern, the back parts of the sweater are knitted one course by sequentially knitting the right back sleeve part 13*b*, the back body 2*b*, and the left back sleeve part 3*b*, first, and, then, the left front sleeve part 3*a* is knitted two courses by the flechage knitting. Then, after the back parts of the sweater are knitted one course by sequentially knitting the left back sleeve part 3*b*, the back body 2*b*, and the right back sleeve part 13*b*, the right front sleeve part 13*a* is knitted two courses by the flechage knitting. Then, after the back parts of the sweater are knitted one course by sequentially knitting the right back sleeve part 13*b*, the back body 2*b*, and the left back sleeve part 3*b*, the left front sleeve part 3*a* and the left half of the front body 2*a* are knitted one course and then flechaged. Then, the left half of the front body 2*a* and the left front sleeve part 3*a* are knitted one course. Then, after the back parts of the sweater are knitted one course by sequentially knitting the left back sleeve part 3*b*, the back body 2*b*, and the right back sleeve part 13*b*, the right front sleeve part 13*a* and the right half of the front body 2*a* are knitted one course and then flechaged. Then, the right half of the front body 2*a* and the right front sleeve part 13*a* are knitted one course. After the processes described above, the knitting of the "d" pattern is ended.

In the knitting of the "d" pattern, the ratio of the number of courses of the front body 2*a* knitted to the number of courses of the back body 2*b* knitted is 1:2; the ratio of the number of courses of the front body 2*a* knitted to the number of courses of the front sleeve parts 3*a*, 13*a* knitted is 1:2; and the ratio of the number of courses of the back body 2*b* knitted to the number of courses of the back sleeve parts 3*b*, 13*b* is 1:1.

In the 4th step, the rectangular knitting part 36 knitted above and continuously with the trapezoidal knitting part 35 and the triangular knitting part 37 are knitted in the sleeve 3(13). Then, the sleeves 3, 13 are joined to the body by joining the shoulder-line-part joining parts 32 to the shoulder-line parts 24 and joining the slant-line-part joining parts 33 to the slant-line-part 26. When the joining of these parts is ended, the neckline forming parts 34 are formed between the shoulder-line-part joining parts 32 and the slant-line-part joining parts 33. In the 4th step, the shoulder drop knitting parts 25 of the front body 2*a*, the back body 2*b*, and the back sleeve parts 3*b*, 13*b* are gradually decreased in number of stitches at ends thereof on the side on which the body and the sleeves are joined together.

Further, in the 4th step, a number of courses knitted required for the sleeves 3, 13 to be joined to the shoulder line parts 24 is previously determined according to lengths of the shoulder lines before the knitting. For example, when the number of wales of the shoulder line parts 24 are 20 stitches, the number of courses of the sleeves 3, 13 knitted are doubled to 40.

Then, the total number of courses of the front and back bodies knitted from the start of joining of the sleeves and the body to the end of joining is also previously determined from the shapes of the front body and the back body. For example, in FIG. 2, a total sum of stitches obtained by adding the number of wales between T and U or t and u of the sleeves 3, 13 (e.g. 14 stitches) to the number of courses between F, f and D, d of the front body 2*a* (e.g. 64 stitches) is the total number of courses knitted (78 stitches).

As to the back body 2*b*, the number of remaining courses to be knitted in the 4th step (30 stitches) can be calculated by subtracting the number of courses already knitted in the 3rd step (e.g. 48 stitches) from the total number of courses knitted (78 stitches).

In the 4th step, with reference to the number of remaining courses of the body (30 stitches) and the number of courses of the sleeves knitted (40 stitches), the ratio of the number of courses of the sleeves 3, 13 to the number of courses of the back body 2*b* knitted is determined to be 4:3 so that the sleeves 3, 13 and the back body 2*b* can be joined together to match with each other between the starting locations and the ending locations for joining together the sleeves 3, 13 and the back body 2*b* and also the joining parts of the sleeves 3, 13 and the back body 2*b* can be prevented from being slackened.

In the 4th step, the difference in number of stitches between the back body 2*b* and the front body 2*a*, which was caused by decreasing the number of courses of the back body 2*b* knitted below the number of courses of the front body 2*a* knitted in the 3rd step, can be made up by increasing the number of courses of the back body 2*b* knitted over the number of courses of the front body 2*a* in the 4th step.

When the joining of the body 2 and the sleeves 3, 13 is completed, the loops of the neckline (K–k of FIG. 2) of the back body 2*b* are held on the back needle bed. When the rectangular knitting parts 36 are formed, the neckline 4 is formed by the front and back bodies 2 and the sleeves 3, 13. On the other hand, when the sleeves and the bodies are joined up to the centers of the sleeves by the knitting method of the 3rd step, without forming the rectangular knitting parts in the sleeves, the sleeves and the body are joined together along D, K, S of FIG. 3, so that the neckline is formed by the front and back bodies.

Loops of the neckline (D–E–F–f–e–d of FIG. 2) of the front body 2*a*, loops of the neckline forming part 34 (T–U of FIG. 2) of the rectangular knitting part 36 of the left front sleeve 3*a*, and loops of the neckline forming part 34 (t–u of FIG. 2) of the rectangular knitting part 36 of the right front sleeve 13*a* are put in the state of being held on the front needle bed. The neckline of double jersey is sequentially knitted in this state.

As an alternative to the illustrated embodiment wherein the shoulder-line parts 24 are formed to extend obliquely with respect to the hem part so that the shoulder drop can be formed by the shoulder-drop knitting parts 25, the shoulder-line parts 24 may be formed to extend parallel with the hem part of the body, without forming the shoulder-drop knitting parts, so as to extend orthogonally to the straight-line parts of the sleeve cuff parts.

INDUSTRIAL APPLICABILITY

The present invention is suitable for knitting seamless knitwear of mixed set-in and raglan sleeves, without one of the bodies being oversupplied with stitches, by using a flat knitting machine.

The invention claimed is:

1. Knitwear comprising a body and sleeves, characterized by:

that one of front and back bodies of the body has armhole parts and shoulder-line parts extending along one's shoulder line formed when wearing the knitwear, and the other body has slant-line parts extending obliquely from the neckline to side parts of the body, that the front body and the back body are knitted in tubular form in a seamless manner, that the sleeves are knitted in tubular form in a seamless manner, that the sleeves are joined to the armhole parts, the shoulder-line parts, slant-line parts of the front and back bodies in a seamless manner, so that a neckline is formed by a part of the sleeves, that as to the number of courses of front and back bodies knitted in the course of joining of the sleeves to the armhole parts of the bodies, the number of courses of the body having the slant-line parts knitted is decreased below the number of courses of the body having the shoulder-line parts knitted, that as to the number of courses of front and back bodies knitted in the course of joining of the sleeves to the shoulder-line parts of the bodies, the number of courses of the body having the slant-line parts knitted is increased over the number of courses of the body having the shoulder-line parts knitted, and that while parts of the sleeves to be joined to the shoulder-line parts are knitted with the number of courses knitted that can prevent shrink of the parts of the sleeves when joined to the shoulder-line parts, the parts of the sleeves and the shoulder-line parts are joined together, and that a ratio of the number of courses for the sleeves and the body having the slant-line parts to be joined together to the number of courses for the sleeves and the body having the slant-line parts to be knitted is set so that when the sleeves and the body having the slant-line parts are joined together to match with each other between the starting locations and the ending locations for joining them together, no slack is produced in the joining parts of the sleeves and the body having the slant-line part, so that the sleeves and the body are joined together in such a ratio.

2. The knitwear according to claim 1, wherein the sleeves knitted to be joined to the body has knitting parts comprising:

armhole-part joining parts joined to the armhole parts, shoulder-line-part joining parts extending continuously to the armhole joining parts and joined to the shoulder-line parts, slant-line-part joining parts joined to the slant-line parts, and neckline forming parts connecting between upper ends of the slant-line-part joining parts and upper ends of the shoulder-line-part joining parts, to form the neckline.

3. A method of knitting knitwear with sleeves formed by using a flat knitting machine having at least a pair of front and back needle beds extending in a transverse direction and disposed opposite to each other in a cross direction, at least either of which is capable of being racked in the transverse direction so that loops can be transferred between the front and back needle beds, the method comprising the following steps for forming armhole parts and shoulder-line parts extending along one's shoulder line formed when wearing the knitwear in any one of a front body and a back body and also forming slant-line parts extending obliquely from a neckline to side parts of the body, 1) the first step of knitting the front body and the back body in tubular form from their hem parts to starting locations for joining the body and the sleeves and knitting the sleeves in tubular form from their sleeve cuff parts, 2) the second step of joining the sleeves to the armhole parts and the slant-line parts, while knitting the front and back bodies and the sleeves with the same number of courses knitted from starting locations for the body and the sleeves to be joined together to locations on the armhole parts, 3) the third step of increasing the number of courses of the body having the shoulder-line parts knitted over the number of courses of the body having the slant-line parts knitted from locations at which the knitting of the armhole parts starts after the second step to locations at which the knitting of the shoulder-line parts start and also joining the sleeves to the armhole parts and the slant-line parts, while the sleeves are knitted, and 4) the fourth step of joining the bodies to the sleeves, while the body having the slant-line parts is knitted with an increased number of courses over the number of courses of the body having the shoulder-line parts knitted and also the sleeve parts joined to the shoulder-line parts are knitted with the number of courses knitted that can prevent formation of shrink in the sleeves joined to the shoulder-line parts, and also setting a ratio of the number of courses for the sleeves and the body having the slant-line parts to be joined together to the number of courses knitted of the sleeves and the body having the slant-line parts so that when the sleeves and the body having the slant-line parts are joined together to match with each other between the starting locations and the ending locations for joining them together, no slack is produced in the joining parts of the sleeves and the body having the slant-line part, whereby the sleeves are joined to the shoulder-line parts and the slant-line parts in such a ratio, while the sleeves are knitted.

4. The knitwear knitting method according to claim 3, wherein in the fourth step, the sleeves have shoulder-line-part joining parts joined to the shoulder-line parts, and slant-line-part joining parts joined to the slant-line parts, and the sleeves are knitted in such a manner that when the joining of these parts is ended, a neckline is formed between the shoulder-line-part joining parts and the slant-line-part joining parts.

* * * * *